US009622543B2

(12) United States Patent
Ramos

(10) Patent No.: US 9,622,543 B2
(45) Date of Patent: Apr. 18, 2017

(54) SHOE LACING SYSTEM

(71) Applicant: Arturo Ramos, Newark, CA (US)

(72) Inventor: Arturo Ramos, Newark, CA (US)

( * ) Notice: Subject to any disclaimer, the term of this patent is extended or adjusted under 35 U.S.C. 154(b) by 0 days.

(21) Appl. No.: 14/583,739

(22) Filed: Dec. 28, 2014

(65) Prior Publication Data

US 2016/0262495 A1 Sep. 15, 2016

(51) Int. Cl.

| | |
|---|---|
| ***A43C 1/00*** | (2006.01) |
| ***A43C 11/00*** | (2006.01) |
| ***A43B 23/00*** | (2006.01) |

(52) U.S. Cl.

CPC ..... *A43C 1/00* (2013.01); *A43B 23/00* (2013.01); *A43C 11/00* (2013.01)

(58) Field of Classification Search

CPC ... Y10T 24/4016; Y10T 24/4077; A43C 1/00; A43C 11/00; A43B 23/00; A43B 23/26

USPC ..... 36/54

See application file for complete search history.

(56) References Cited

U.S. PATENT DOCUMENTS

| | | | | |
|---|---|---|---|---|
| 2,007,157 | A * | 7/1935 | Cockrum | A43B 23/26 24/713.4 |
| 5,933,985 | A * | 8/1999 | James | A43B 7/1495 36/50.1 |
| 6,052,921 | A * | 4/2000 | Oreck | A43C 1/00 36/50.1 |
| 7,386,947 | B2 * | 6/2008 | Martin | A43B 5/0401 36/10 |
| 2007/0227045 | A1 * | 10/2007 | Aveni | A43B 3/24 36/54 |

* cited by examiner

*Primary Examiner* — Robert J Sandy
(74) *Attorney, Agent, or Firm* — Morgan Law Offices, PLC

(57) ABSTRACT

A shoe lacing system is provided that can include a shoelace attachment portion disposed on a tongue of the shoe lacing system between a pair of shoelace receivers, the shoelace attachment portion includes notches disposed on the shoelace attachment portion to receive and couple the shoelace. The shoe lacing system can include a pair of sliding members coupled underneath a pair of shoelace receivers that are adapted to move along a track underneath the pair of sliding members, the ends of each of the loop segments are coupled to either one of the pair of shoelace receivers or one of the pair of sliding members. The shoe lacing system can include shoelace loops that are tensioned by pulling each of the shoelace loops and crossing and coupling each of the shoelace loops to notches disposed outside of each of the pair of shoelace outlets.

6 Claims, 4 Drawing Sheets

SHOE LACING SYSTEM

BACKGROUND OF THE INVENTION

1. Field of the Invention

The present invention relates to an improved shoe lacing system.

2. Description of the Related Art

Shoelaces have been used to secure shoes and boots for several thousand years. Although early shoelaces were made of leather, most shoelaces today are made of a cloth material, such as cotton. The conventional method of using shoelaces involves initially threading the shoelace through alternating eyelets until a pair of shoelace ends extend freely from the last eyelets. The user inserts his or her foot in the shoe or boot, and the shoelace ends are pulled to tighten the shoe around the foot. Typically, the pair of shoelace ends is tied in a bow to secure the shoelace. Of course, the same procedure must be done for each of a pair of shoes.

Although shoes and booting using traditional shoe lacing are still widely used, there are several shortcomings. One of the most frequent difficulties is that often shoelaces can become untied which can present a tripping hazard particularly when the user is unaware his or her shoelaces are untied. Additional problems with traditional shoe lacing include the time it takes a user to tie the shoes and the fact that the shoelace ends can become unraveled. Although the ends of shoelaces are typically encased with a plastic tip called an aglet, the aglet can break fairly easily. Once an aglet breaks, the shoelace end becomes unraveled and it becomes difficult to thread the shoelace back through the eyelets.

SUMMARY OF THE INVENTION

One aspect of the disclosure relates to a shoe lacing system, comprising a shoelace forming a continuous loop; a pair of shoelace receivers disposed on corresponding opposite sides of a shoe, the pair of shoelace receivers receiving the shoelace extending through an interior channel within each of the pair of shoelace receivers; and a shoelace attachment portion disposed on a tongue of the shoe, the shoelace attachment portion including a plurality of notches to receive and couple the shoelace thereby securing a user's foot within the shoe. The shoe is secured by pulling on an end of the shoelace and coupling the shoelace to a selected one of the notches, and it can be unsecured by releasing the shoelace from the notch.

Another aspect of the invention relates to a shoe lacing system, comprising a shoelace having a plurality of loop segments; a pair of shoelace receivers each disposed on corresponding opposite sides of a tongue of a shoe; a pair of sliding members coupled underneath the pair of shoelace receivers that are adapted to move along a track underneath the pair of sliding members, the ends of each of the loop segments coupled to either one of the pair of shoelace receivers or one of the pair of sliding members; and a shoelace attachment portion disposed on the tongue of the shoe between the pair of shoelace receivers, the shoelace attachment portion including a plurality of notches to receive and couple one of the loop segments securing the shoe.

Yet another aspect of the invention relates to a shoe lacing system, comprising a pair of shoelace loops including a first shoelace loop and a second shoelace loop; a pair of shoelace outlets each having a plurality of holes, the pair of shoelace loops coupled underneath the pair of shoelace outlets and extend through the holes; and a plurality of notches disposed outside of each of the pair of shoelace outlets, the notches including a first set of notches and a second set of notches. The shoelace loops are tensioned by pulling each of the shoelace loops and crossing the first loop through the second loop and coupling each of the shoelace loops to a selected notch.

DETAILED DESCRIPTION OF THE INVENTION

Figure 1:
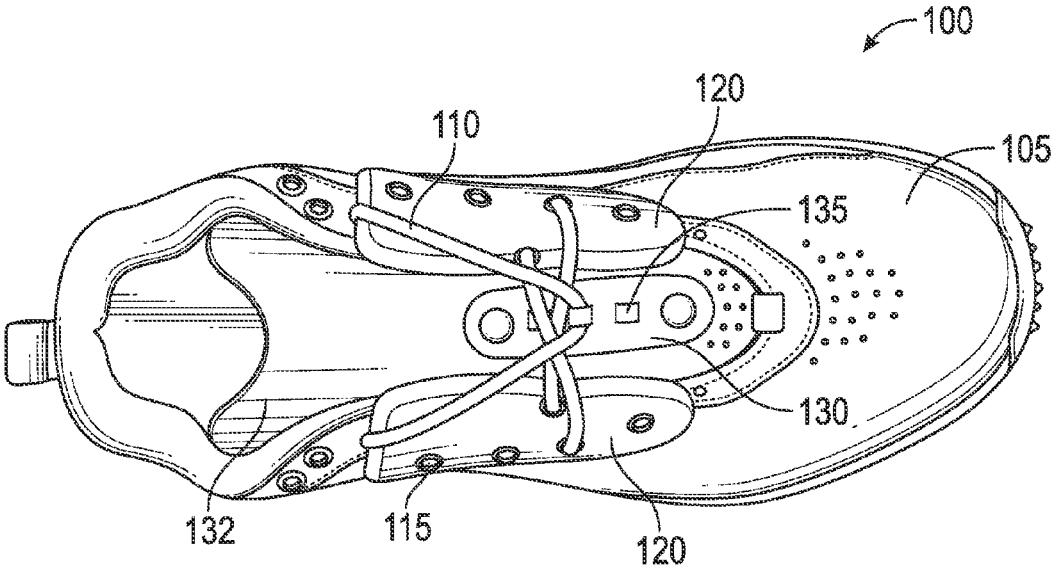
FIG. 1 illustrates a shoe lacing system, according to an embodiment of the invention.

Referring to FIG. 1, a shoe lacing system 100 is illustrated, according to an embodiment of the invention. The shoe lacing system 100 is shown in its secured configuration. As shown, the shoe lacing system 100 includes a shoelace 110, a pair of shoelace receivers 120 and a shoelace attachment portion 130. The shoelace 110 forms a continuous loop rather than having free ends. The shoelace receivers 120 are disposed on corresponding opposite sides of a shoe 105. The pair of shoelace receivers 120 receives the shoelace 110 that extends through the pair of shoelace receivers 120. The pair of shoelace receivers 120 each has a plurality of holes 115 which accept the shoelace 110. The shoelace 110 then may travel through an interior channel within each of the pair of shoelace receivers 120.

The shoelace attachment portion 130 may be lengthwise disposed on a tongue 132 of the shoe lacing system 100 between the pair of shoelace receivers 120.

The shoelace attachment portion 130 can be attached by bolting, adhering, or stitching, for example, to the tongue 132. As shown, the shoelace attachment portion 130 includes a plurality of notches 135 disposed on the shoelace attachment portion 130 to receive and couple the shoelace 110 thereby securing the user's foot (not shown) within the shoe 105 without tying the shoelace 110. The notches 135 may be raised notches or the like. Although three notches 135 are illustrated in FIG. 1, it is to be understood that any suitable number of notches 135 may be disposed on the shoelace attachment portion 130. The selection of a particular notch 135 by the user when securing the shoe lacing system 100 helps determine the tightness of the fit of the shoe 105 on the user's foot.

Although the shoe lacing system 100 illustrated in FIG. 1 is used in combination with an "athletic" shoe 105 (a sneaker), it is to be understood that the shoe lacing system 100 could be used in combination with any suitable piece of footwear such as a dress shoe, a boot, a sandal, or the like. It is further to be understood that although a single shoe 105 is shown (which fits a right foot), the shoe lacing system 100 would actually be used for each of a pair of shoes.

Figure 2:
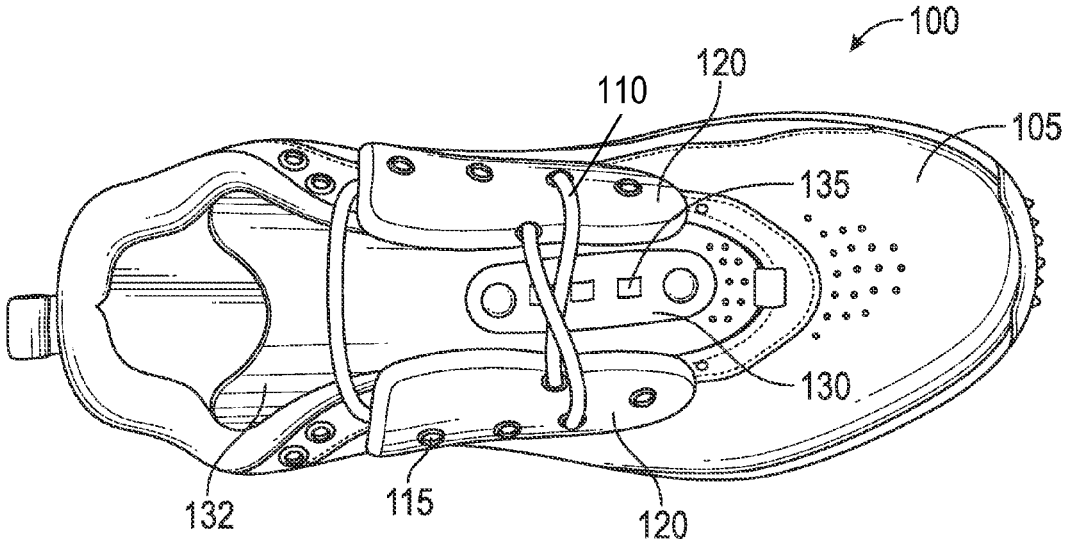
FIG. 2 illustrates the shoe lacing system of FIG. 1 in an unsecured configuration.

FIG. 2 illustrates the shoe lacing system 100 in an unsecured configuration. To secure the shoe 105, the user simply pulls on the end of the shoelace 110 and toward the front of the shoelace 110, and couples the shoelace 110 to one of the notches 135 on the shoelace attachment portion 130. To unsecure the shoe 105, the user pulls the end of shoelace 110 off of the notch 135 that the shoelace 110 is coupled to and releases the shoelace 110 from the notch 135.

Figure 3:
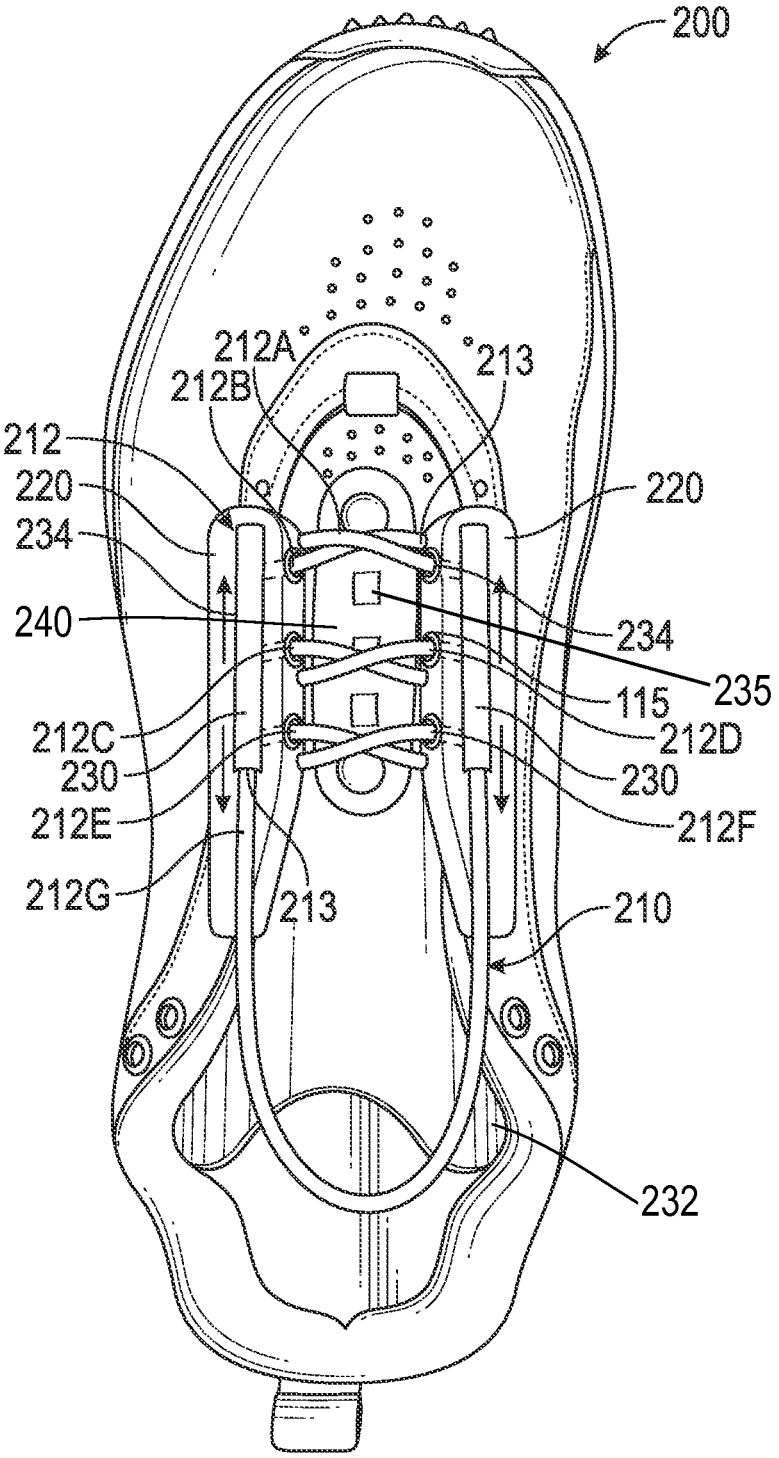
FIG. 3 illustrates a shoe lacing system, according to another embodiment of the invention.

Referring to FIG. 3, a shoe lacing system 200 is illustrated, according to another embodiment of the invention. As shown, the shoe lacing system 200 includes a shoelace 210, a pair of shoelace receivers 220 and a pair of sliding members 230. Notably, the shoelace 210 is not a continuous loop but rather a plurality of loop segments 212. Although FIG. 3 illustrates seven loop segments 212, a different number of loop segments 212 may be used. The loop segments 212 include a first loop segment 212A, a second loop segment 212B, a third loop segment 212C, a fourth loop segment 212D, a fifth loop segment 212E, a sixth loop segment 212F and a seventh loop segment 212G. The pair of shoelace receivers 220 are each disposed on corresponding opposite sides of the shoe lacing system 200. The pair of sliding members 230 are coupled underneath the pair of shoelace receivers 220, and can be adapted to move along a track 234 underneath the pair of sliding members 230. The ends of each of the loop segments 212 may be coupled to either one of the pair of shoelace receivers 220 or one of the pair of sliding members 230 and fastened with a plurality of sewn thread 213 or the like fastener. The first loop segment 212A, the second loop segment 212B, the third loop segment 212C, the fourth loop segment 212D, the fifth loop segment 212E, the sixth loop segment 212F and the seventh loop segment 212G provide support between the pair of shoelace receivers 220 and the pair of sliding members 230, as well as provide an ornamental appearance. The seventh loop segment 212G is coupled to an end 230A of each of the pair of sliding members 230 and can be pulled to move the pair of shoelace receivers 220 and the pair of sliding members 230 along the track 234 thereby extending the seventh loop segment 212G. Additionally, the shoe lacing system 200 may include a shoelace attachment portion 240. The shoelace attachment portion 240 may be disposed on a tongue 232 of the shoe lacing system 200 between the pair of shoelace receivers 220.

The shoelace attachment portion 240 may include a plurality of notches 235 disposed on the shoelace attachment portion 240 to receive and couple the seventh loop segment 212G, thereby securing the user's foot (not shown) within the shoe 205 without tying the shoelace 210 or the like. The notches 235 may be raised notches 235A or the like. Although three notches 235 are illustrated, it is to be understood any suitable number of notches 235 may be disposed on the shoelace attachment portion 240. The seventh loop segment 212G of the loop segments 212 may be tensioned pulled and secured onto a desired notch 235 thereby determining the tightness of the fit of the shoe 205.

Figure 4:
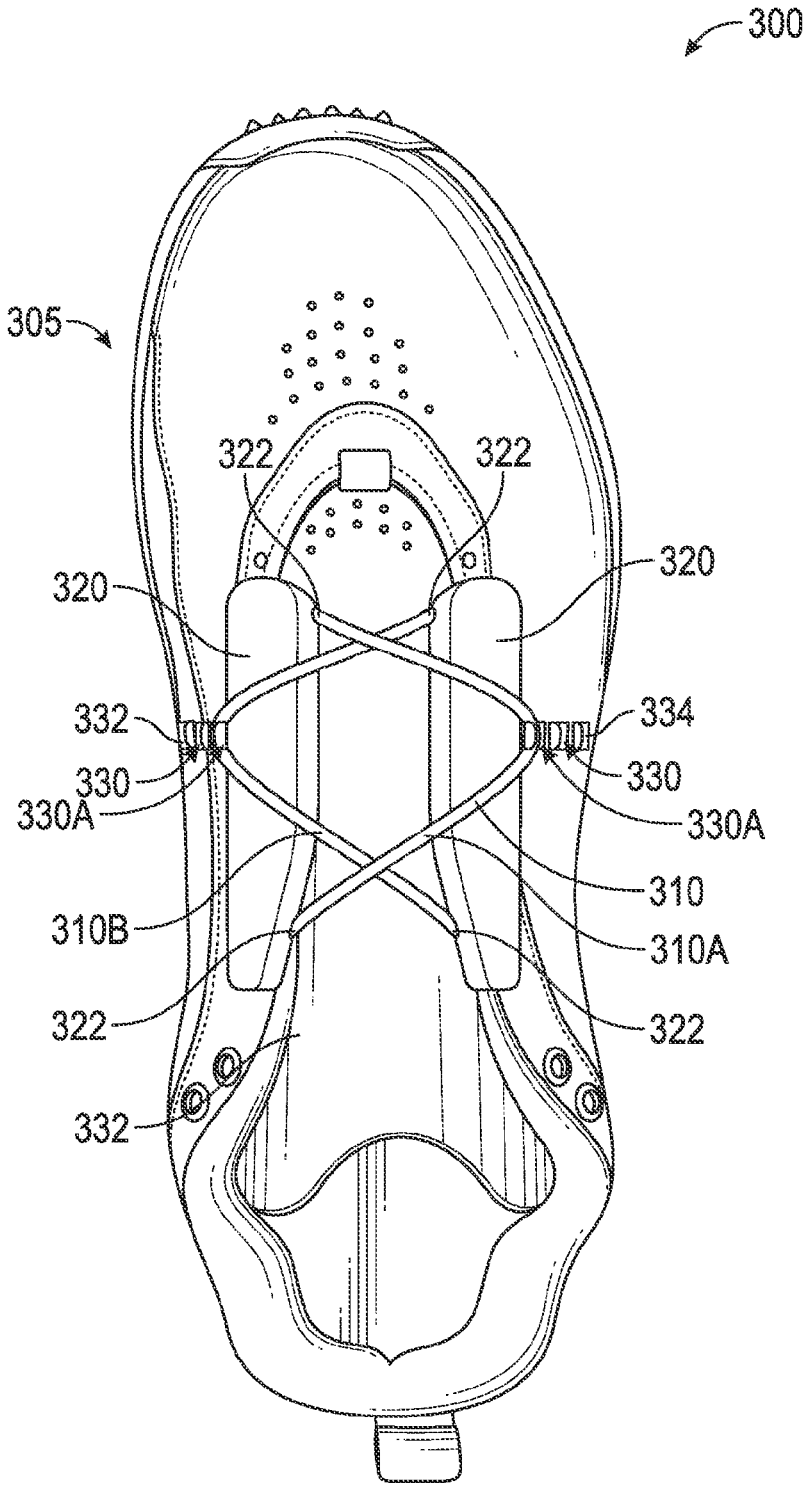
FIG. 4 illustrates a shoe lacing system, according to another embodiment of the invention.

Referring to FIG. 4, a shoe lacing system 300 is illustrated, according to another embodiment of the invention. As shown, the shoe lacing system 300 includes a pair of shoelace loops 310, a pair of shoelace outlets 320 and a plurality of notches 330. The pair of shoelace loops 310 includes a first shoelace loop 310A and a second shoelace loop 310B. The pair of shoelace outlets 320 each includes a plurality of holes 322. The pair of shoelace loops 310 is coupled underneath the pair of shoelace outlets 320 and extends through the holes 322. The notches 330 may be disposed outside of each of the pair of shoelace outlets 320 on the shoe 305. The notches 335 may be raised notches 335A or the like. The notches 330 may include a first set of notches 332 and a second set of notches 334. As illustrated in FIG. 4, the first set of notches 332 and the second set of notches 334 each include three notches, but may include any suitable number of notches. The pair of shoelace loops 310 can be tensioned by pulling each of the pair of shoelace loops 310 and crossing the first loop 310A through the second loop 310B and coupling each of the pair of shoelace loops 310 to a desired notch 330, thereby determining the tightness of the fit of the shoe 305.

Figure 5:
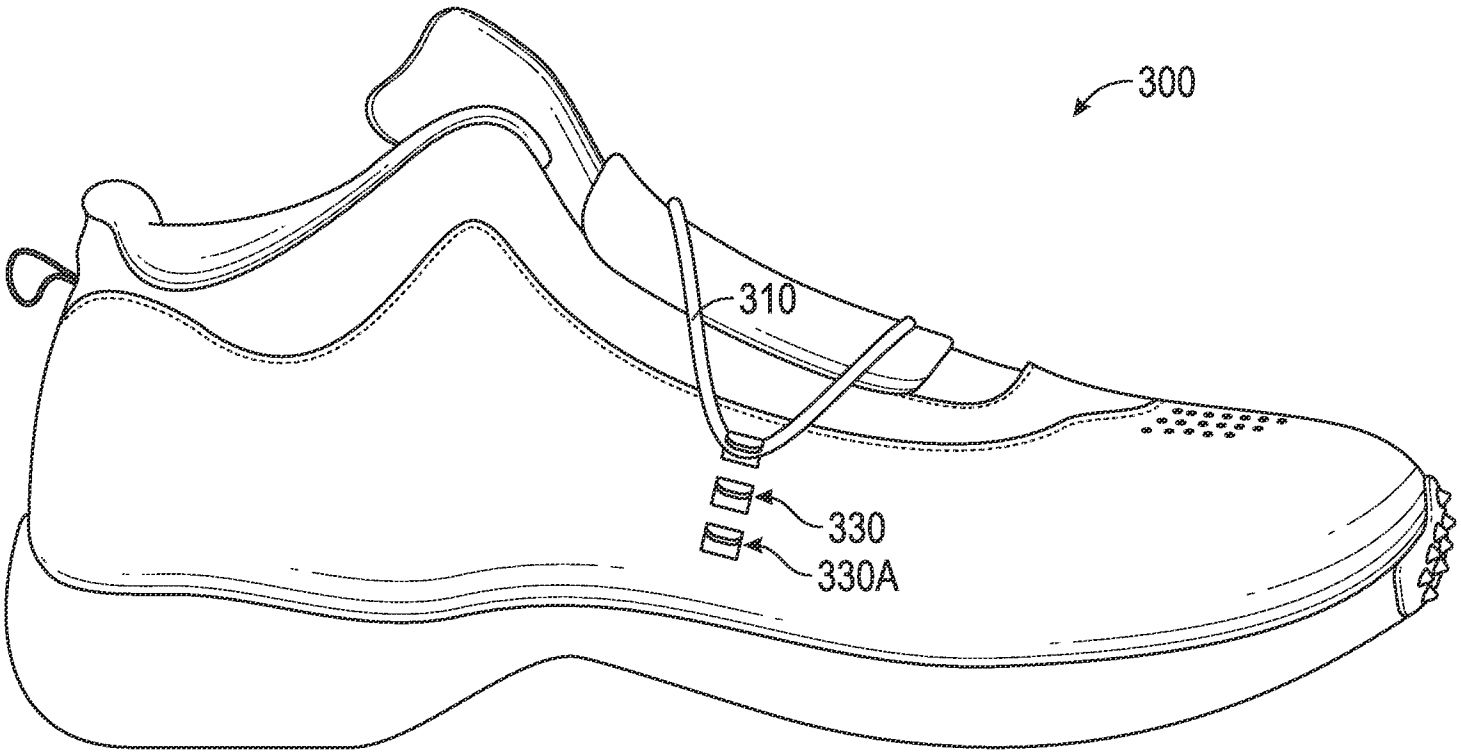
FIG. 5 illustrates a side view of the shoe lacing system of FIG. 4.

FIG. 5 illustrates is a side view showing one of the pair of shoelace loops 310 coupled to one of the notches 330 of the shoe lacing system 300.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A shoe lacing system, comprising:

a shoelace forming a continuous loop;

a pair of shoelace receivers disposed on corresponding opposite sides of a shoe, the pair of shoelace receivers receiving the shoelace extending through an interior channel within each of the pair of shoelace receivers; and a shoelace attachment portion disposed on a tongue of the shoe, the shoelace attachment portion including a plurality of notches to receive and couple the shoelace;

wherein the shoe is unsecured by releasing the shoelace from a notch.

2. The shoe lacing system according to claim 1, wherein the shoelace attachment portion is lengthwise disposed on the tongue of the shoe.

3. The shoe lacing system according to claim 1, wherein the shoelace attachment portion is adhered, bolted or stitched to the tongue.

4. The shoe lacing system according to claim 1, wherein the shoe is secured by pulling on an end of the shoelace and coupling the shoelace to a selected one of the notches.

5. The shoe lacing system according to claim 1, wherein the notches are raised notches.

6. The shoe lacing system according to claim 1, wherein the shoe is an athletic shoe.

* * * * *